United States Patent [19]

Furman

[11] Patent Number: 4,656,724

[45] Date of Patent: Apr. 14, 1987

[54] TOOL FOR THE INSTALLATION OF A COAXIAL TAP

[75] Inventor: Lev B. Furman, York, Pa.

[73] Assignee: AMP Incorporated, Harrisburg, Pa.

[21] Appl. No.: 792,408

[22] Filed: Oct. 29, 1985

[51] Int. Cl.[4] ..... H01R 43/00

[52] U.S. Cl. ..... 29/566; 7/107; 7/142; 7/158; 29/750; 29/758

[58] Field of Search ..... 29/566, 750, 758; 408/202, 241; 7/107, 142, 158

[56] References Cited

U.S. PATENT DOCUMENTS 916,620 3/1909 Shaul ..... 7/142

3,301,101 1/1967 McEwan ..... 408/202 X

*Primary Examiner*—Carl E. Hall

*Attorney, Agent, or Firm*—Gerald K. Kita

[57] ABSTRACT

A tool for connecting a tap assembly to a tap body for making an electrical connection to an electrical cable having a conducting core and an insulator sheath and an outer conductor is adapted for hand rotation. A first end of the tool is adapted with an internal configuration to rotate a threaded tap assembly into a recess in a threaded aperture in the floor of a cable-engaging member. The second end includes a drill and a depth stop geometry to drill into the insulator sheath through the threaded aperture in the floor.

5 Claims, 4 Drawing Figures

TOOL FOR THE INSTALLATION OF A COAXIAL TAP

FIELD OF THE INVENTION

This invention relates to a tool for installing a tap to a coaxial cable without cutting the cable.

BACKGROUND OF THE INVENTION

A coaxial active tap is disclosed in copending patent application Ser. No. 439,240, filed Nov. 3, 1982, and now U.S. Pat. No. 4,588,249, issued May 13, 1986, for Coaxial Cable Tap Connector, and assigned to the assignee of the present application. That application describes a tap with three subassemblies. First and second of the subassemblies cooperate to sandwich a cable to be tapped. A third subassembly is slidably assembled on to both the first and the second subassemblies to hold the subassemblies temporarily on the cable. The subassemblies then are secured together by a bolt fastener. The first assembly called the "tap body", includes a lateral aperture which is internally threaded to attach a probe assembly. The probe assembly includes an anterior needle which passes along an opening through the outer conductor of the cable as well as the cable insulating sheath and contacts the electrically conducting core of the cable.

Prior to the attachment of the probe assembly, the opening through the outer conductor of the cable as well as the cable insulating sheath is formed by being drilled out through the lateral aperture. The various steps in the tap procedure thus require a drill and a means for tightening the attached probe assembly. Both the drill and the tightening means are adapted to fit within the lateral aperture and the drill is adapted to seat in a manner to prevent penetration of the cable core. The present invention is directed at a single tool adapted to perform the requisite procedures.

BRIEF DESCRIPTION OF AN ILLUSTRATIVE EMBODIMENT OF THE INVENTION

A tool in accordance with the principles of the present invention for installing a coaxial active tap comprises an elongated cylindrical member having first and second ends. The first end of the member is adapted to have an internal cross section to mate with the probe assembly. For example, the probe assembly has an integral hexagonal nut and the first end has a mating hexagonal opening. The first end also is of a shape to permit insertion of the first end into a probe assembly receiving area in the tap body.

The second end of the tool includes an integral drill recessed into and spaced apart from an annular wall which forms a receptacle for receiving shavings from the insulating sheath. The second end also has a depth stop for seating against a matching bearing surface in the tap body thereby to limit the drill penetration. The tool is configured for hand use and conveniently comprises a hollow plastic assembly.

DETAILED DESCRIPTION

Figure 1:
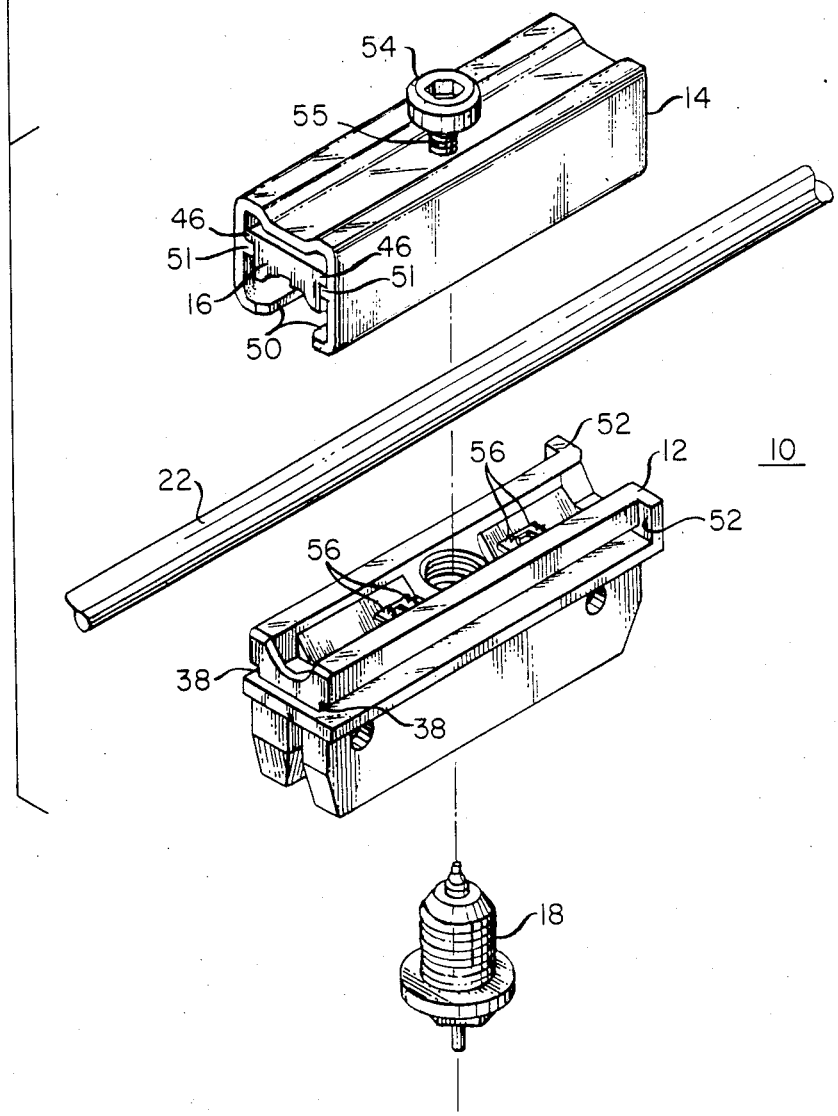
FIGS. 1 and 2 are exploded perspective views of portions of a coaxial cable tap connector.

FIG. 1 shows an exploded view of a cable tap connector 10 with a signal probe assembly installed by an installation tool in accordance with the present invention. The connector includes a cable-engaging member 12, a clamp-retaining member 14, and a clamp member 16. The signal probe assembly is designated 18.

An electrical tap into a coaxial cable 22 is made by sandwiching cable 22 between cable-engaging member 12 and clamp member 16. Then clamp-retaining member 14 is slidably assembled along recesses 38 and projections 46 of members 12 and 16 respectively. Clamo-retaining member 14 is extruded from a suitable metal and has rails or projections 50 and 51 adapted to slidably enter and traverse along recesses 38 and projections 46 respectively.

The extent of traverse of clamp-retaining member 14 is limited by the projections 50 and 51 engaging stop members 52 that project across the recess 38. The three subassemblies are locked together by a bolt 54 projecting into opening 55 in a top wall of the member 14 for threaded receipt in a threaded nut (not shown) on the opposite side of the top wall. Bolt 54, when threadably advanced, moves clamp member 16 relative to clamp-retaining member 14 in a manner to secure the subassemblies together.

Tines 56 on the member 12 are adapted to make electrical contact to the outer cylindrical conductor of the coaxial cable 22. The assembly of the connector and the manner of connection between the tines and the outer conductor of the cable are fully described in the above-mentioned copending patent application. The foregoing description is merely a summary of the connector piece parts and organization as a context for an understanding of the present invention.

Figure 2:
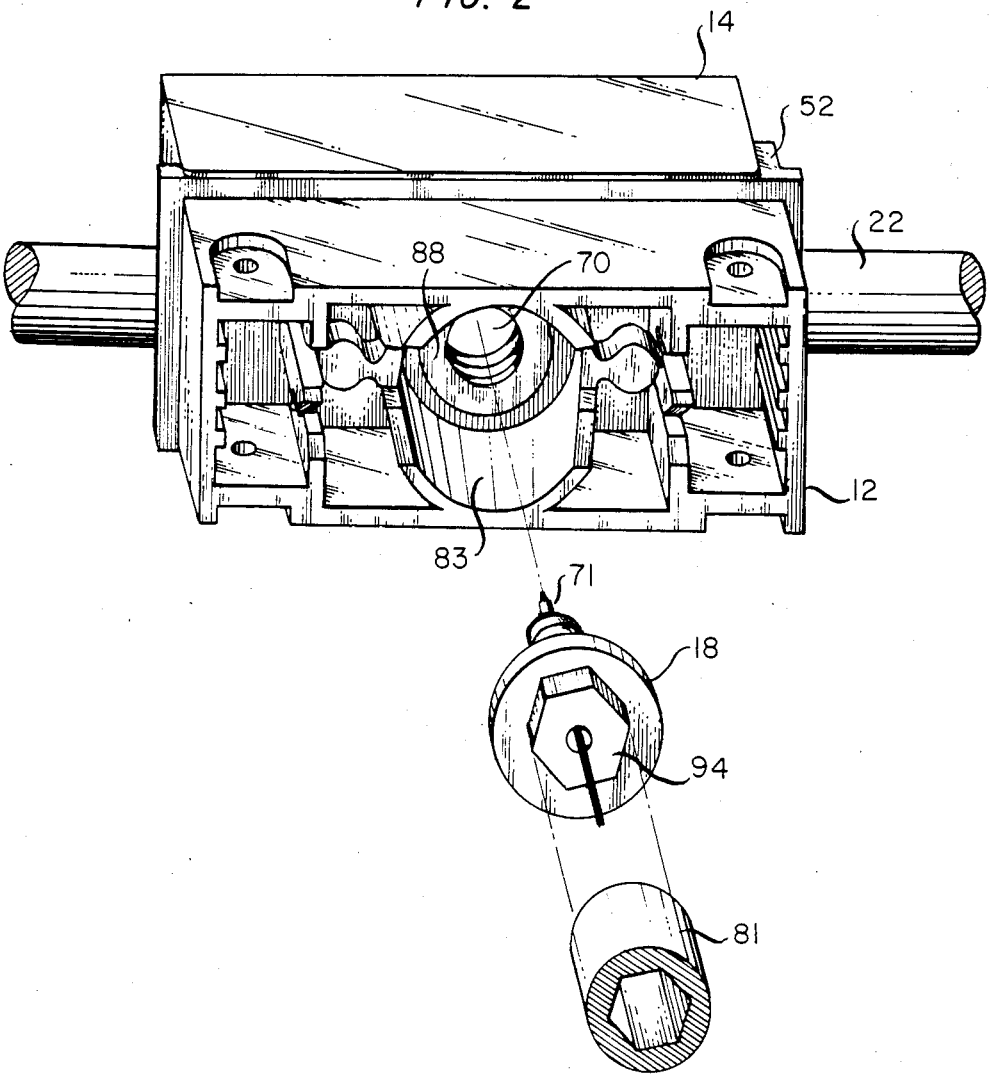

The present invention is directed at a tool for installing probe assembly 18 into a recess in cable-engaging member 12 in a manner to make electrical connection to the electrically conducting center conductor or core of cable 22 and yet be insulated from the outer conductor of cable 22. FIG. 2 shows the bottom of cable-engaging member 12 adapted for receiving probe assembly 18. Cable 22 is shown in place with the outer conductor of the cable already electrically contacting tines 56. The cable is exposed for connection to its conducting core through hole 70 in member 12 as shown in FIG. 2. Assembly 18 is adapted to screw into hole 70. Assembly 18 includes a needle 71 which contacts the cable core and has an electrically-insulating sheath encircling the needle which insulates the needle from the outer conductor of the cable as disclosed fully in the above-mentioned copending application.

Cable 22 typically has an outer insulative jacket which is quite rugged and difficult to penetrate. Consequently, it is helpful to drill through the outer jacket and even through the outer conductor of the cable and partially into the insulating dielectric sheath concentrically between the outer conductor and the conducting center conductor or core of the cable. The drilling procedure heretofore has required the installation of a tool fixture in hole 70 to provide a drill guide having a smaller hole for a dril bit and a stop to limit the extent of travel of the drill bit. The use of such a fixture is a time consuming procedure and is inconvenient particularly with respect to the difficulty of removing shavings caused by the drilling.

Figure 3:
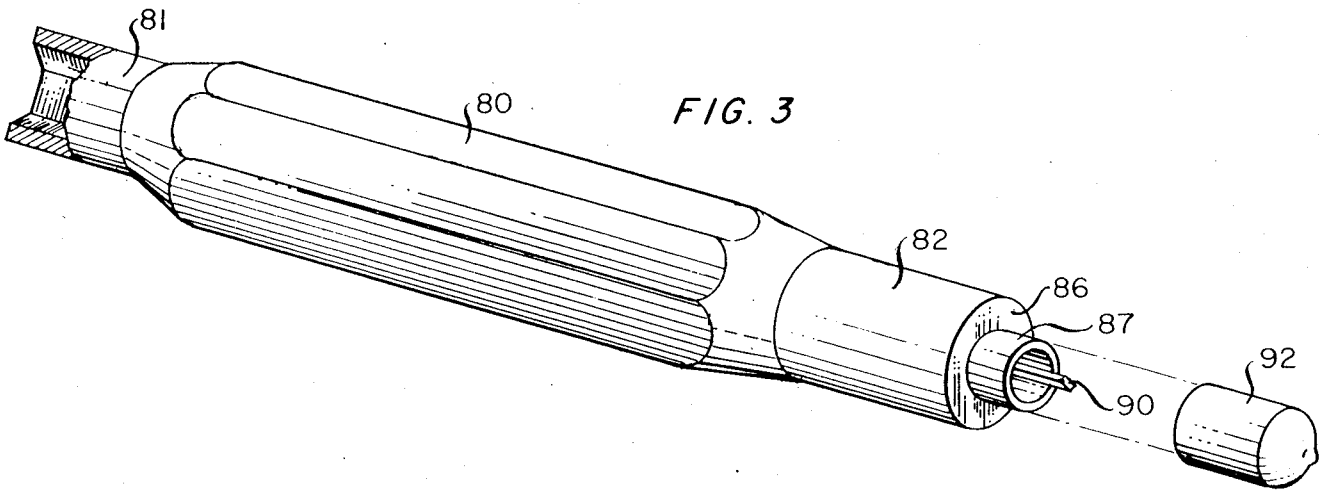
FIG. 3 is a perspective view, partially cut away, of a tool in accordance with this invention for installing the cable tap of the connector of FIG. 1.

FIG. 3 shows a hand operative tool 80 for the installation of probe assembly 18. The tool has a body portion approximately seven inches long and about an inch in diameter and has a hexagonal cross section adapted to provide a comfortable grip for the hand. Both ends 81 and 82 of the tool have reduced diameters to fit within recess 83 of cable-engaging member 12 shown in FIG. 2. The outer face 86 of end 82 bears against annular shoulder of stop 88 concentrically projecting into recess 83. Annular wall 87 extends outwardly from face 86 and drill bit 90 is set into end 82 in alignment with the axis of tool 80 as shown. Annular wall 87 and drill bit 90 are adapted to advance along hole 70 to an extent allowed until limited by stop 88 bearing against face 86. The extent of penetration into the cable 22 is limited thereby as described, to prevent damage to the outer conductor or core.

Figure 4:
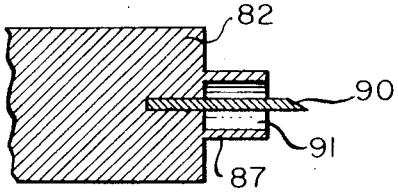
FIG. 4 is a cross section view of a portion of the tool of FIG. 3.

Annular wall 87 forms a recess 91 concentrically about drill bit 90 as shown in the cross section view of FIG. 4. The recess provides a receptacle for shavings generated during the drilling procedure which might interfere and cause a poor connection to the conductor core of the cable. A removable cap 92 fits frictionally over annular wall 87 as shown in FIG. 3. The cap protects an operator from being cut by the drill as well as protects the drill from damage.

End 81 of tool 80 has an internal cross section which is hexagonal and adapted to mate with hexagonal nut 94 of the probe assembly 18 as shown in FIG. 2. FIG. 3 is shown partially cut away to demonstrate the hexagonal configuration of end 81. Tool 81 conveniently is hollow to reduce weight. The tool wall thickness of about three-sixteenths of an inch provides a sufficiently rugged structure for the tool. The tool 80 is made of Wylon 6/6. The cap 92 is made of Vinyl 701.

What is claimed is:

1. A tool for installing a probe assembly in a recess in a cable-engaging member, said recess having a depth stop and an aperture of rrelatively small diameter therebeyond, said tool comprising, a body portion having a hand grippable portion and first and second ends, said second end comprising a drill extending from the face thereof, said second end having a geometry to engage said depth stop for limiting the depth of penetration of said drill into said aperture, said first end constructed with an exterior geometry fitting within and rotatable within said recess, said first end being hollow and having an internal geometry constructed with a shape engagable with and complementary with a corresponding shape of said probe assembly to rotate said probe assembly together with said first end.

2. A tool as recited in claim 1 wherein, said first end has a hexagonal internal geometry complementary with and matable with a hexagonal end portion of said probe assembly.

3. A tool as recited in claim 2 and further including, an annular wall extending from said face, said wall encompassing said drill and providing a recess thereabout, said annular wall has a geometry to fit within said aperture and said drill extends beyond said annular wall.

4. A tool as recited in claim 3 wherein, said first end has a hexagonal internal geometry complementary with and matable with a hexagonal end portion of said probe assembly.

5. A tool as recited in claim 3 and further including, a cap covering said drill and engaging said annular wall with a snug fit.

* * * * *